US007965234B2

(12) United States Patent
Park et al.

(10) Patent No.: US 7,965,234 B2
(45) Date of Patent: Jun. 21, 2011

(54) BEAMFORMING APPARATUS AND METHOD FOR MULTI-ANTENNA SYSTEM

(75) Inventors: Chul Gyun Park, Gyunggi-do (KR); Young Chai Ko, Seoul (KR); Kyung Tae Jo, Gyunggi-do (KR); Joun Sup Park, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 0 days.

(21) Appl. No.: 12/850,233

(22) Filed: Aug. 4, 2010

(65) Prior Publication Data

US 2011/0032150 A1 Feb. 10, 2011

(30) Foreign Application Priority Data

Aug. 6, 2009 (KR) ..... 10-2009-0072419
Apr. 13, 2010 (KR) ..... 10-2010-0033808

(51) Int. Cl.
*H01Q 3/00* (2006.01)

(52) U.S. Cl. ..... 342/372

(58) Field of Classification Search ..... 342/372
See application file for complete search history.

(56) References Cited

U.S. PATENT DOCUMENTS 6,166,690 A * 12/2000 Lin et al. ..... 342/383
2004/0178954 A1* 9/2004 Vook et al. ..... 342/383
2006/0067277 A1* 3/2006 Thomas et al. ..... 370/334
2007/0037528 A1* 2/2007 Doan et al. ..... 455/101
2009/0121936 A1* 5/2009 Maltsev et al. ..... 342/377

* cited by examiner

*Primary Examiner* — Thomas H Tarcza
*Assistant Examiner* — Frank McGue
(74) *Attorney, Agent, or Firm* — Lowe, Hauptman, Ham & Berner, LLP

(57) ABSTRACT

A beamforming apparatus for a multi-antenna system includes a phase control unit including a plurality of phase shifters which respectively control the phases of signals according to a preset phase weight vector; a signal combination unit combining the signals outputted from the plurality of phase shifters; a frequency down converter down-converting the combined signal outputted from the signal combination unit into a baseband signal; an analog/digital (A/D) converter converting the baseband signal into a digital signal; and a radio frequency (RF) beamforming control unit providing a plurality of preset phase weight vectors to the phase control unit according to a preset application sequence, deciding a maximum signal-to-noise ratio (SNR) among a plurality of SNRs corresponding to the applied phase weight vectors by using the digital signal outputted from the A/D converter, and controlling the beamforming of the phase control unit by using the maximum SNR.

15 Claims, 11 Drawing Sheets

(1) SNR4[k] > SNR5[k]
(2) SNR4[k] > SNR3[k]
(3) SNR4[k] -> SNRmax[k]으로 결정

BEAMFORMING APPARATUS AND METHOD FOR MULTI-ANTENNA SYSTEM

CROSS-REFERENCE TO RELATED APPLICATIONS

This application claims the priorities of Korean Patent Application Nos. 10-2009-0072419 filed on Aug. 6, 2009 and 10-2010-0033808 filed on Apr. 13, 2010, in the Korean Intellectual Property Office, the disclosures of which are incorporated herein by reference.

BACKGROUND OF THE INVENTION

1. Field of the Invention

The present invention relates to a beamforming apparatus and method for a multi-antenna system, and more particularly, to a beamforming apparatus and method which performs radio frequency (RF) beamforming by using one analog-to-digital (A/D) converter and decides a phase weight vector capable of acquiring a maximum signal-to-noise ratio (SNR), in a multi-antenna system using a plurality of antennas.

2. Description of the Related Art

In general, a wireless communication system using multiple antennas or spaced antennas (hereinafter, referred to as "multi-antennas") for high-speed wireless communications is being developed. Beamforming is one of several technologies using multi-antennas and is widely known as a method in which a receiver or transmitter uses multi-antennas to increase connection reliability in wireless environments.

Worldwide interoperability for microwave access (WiMax) standard, long-term evolution (LTE), IEEE802.11n WLAN, IEEE802.15.c WPAN and so on may be taken as examples of wireless environments in which such multi-antennas are used. In order to implement a multi-antenna system, an equal number of RF chain units configured with a low noise amplifier (LNA), a mixer, a filter, an intermediate frequency (IF) signal, and an A/D converter are needed. Therefore, the price, power consumption, and size of a multi-antenna system are being considered as problems in implementing the multi-antenna system.

In particular, it is known that an A/D converter has the highest power consumption when processing baseband signals. To minimize this power consumption, analog beamforming or RF beamforming technology employing a minimum number of RF components may be used. In the existing baseband beamforming technology, signals received by antennas should be converted into digital signals through an A/D converter so as to calculate a weight vector which maximizes an SNR.

However, when the analog beamforming technology is used, the phases of signals received by antennas are converted by phase shifters and then summed. Therefore, only one A/D converter having high power consumption may be used. Accordingly, research and development on the analog beamforming technology has been conducted intensively.

In the baseband beamforming technology according to the related art, signals received by multi-antennas may be converted into digital signals through an A/D converter so as to acquire an optimal weight vector through eigenvalue decomposition. When this technology is used, the direction of a signal received by an antenna may be accurately estimated. Therefore, it is possible to improve the performance of the multi-antenna system. However, when the analog beamforming is used, the eigenvalue decomposition cannot be used. Therefore, there is a demand for a new method for acquiring an optimal weight vector.

In a technique which estimates a weight vector using the analog beamforming technology according to the related art, all possible vectors are applied to find an optimal vector.

However, since finding an optimal vector for all vectors may increase the complexity of a system, it is difficult to apply to an actual system.

SUMMARY OF THE INVENTION

An aspect of the present invention provides a beamforming apparatus and method which performs radio frequency (RF) beamforming by using a single analog-to-digital (A/D) converter and decides a phase weight vector capable of acquiring a maximum signal-to-noise ratio (SNR), in a multi-antenna system using a plurality of antennas.

According to an aspect of the present invention, there is provided a beamforming apparatus for a multi-antenna system, including: a phase control unit including a plurality of phase shifters which respectively control the phases of signals received from a plurality of antennas according to a preset phase weight vector; a signal combination unit combining the signals outputted from the plurality of phase shifters; a frequency down converter down-converting the combined signal outputted from the signal combination unit into a baseband signal; an analog/digital (A/D) converter converting the baseband signal outputted from the frequency down converter into a digital signal; and a radio frequency (RF) beamforming control unit providing a plurality of preset phase weight vectors to the phase control unit according to a preset application sequence, deciding a maximum signal-to-noise ratio (SNR) among a plurality of SNRs corresponding to the applied phase weight vectors by using the digital signal outputted from the A/D converter, and controlling the beamforming of the phase control unit by using the maximum SNR.

The RF beamforming control unit may include: a phase weight vector codebook including the plurality of phase weight vectors which are divided into a plurality of first to m-th arrangement ranges in consideration of phase correlations; a phase control section applying the plurality of phase weight vectors of the phase weight vector codebook according to the preset application sequence, deciding the maximum SNR by using a comparison result among the plurality of SNRs corresponding to the applied phase weight vectors, and controlling the respective phases of the phase shifters by using the maximum SNR; an SNR detection unit detecting SNRs for the applied phase weight vectors by using the digital signal outputted from the A/D converter; and an SNR comparison unit comparing the detected SNRs for the applied phase weight vectors, which are outputted from the SNR detection unit, and providing the comparison result to the phase control section.

The phase control section may decide a maximum SNR in a preset start arrangement range among the first to m-th arrangement range of the phase weight vector codebook, decide maximum SNRs in the other arrangement ranges by using periodicity of the SNRs which occurs depending on the arrangement ranges having the phase correlations among the plurality of phase weight vectors, and decide a maximum SNR having the greatest value among the maximum SNRs of the first to m-th arrangement ranges.

An arrangement range in which the maximum SNR is highly likely to be searched for, among the plurality of first to m-th arrangement ranges, may be previously set to the start arrangement range.

An intermediate arrangement range which is expected to be favorable for reducing the search time of the maximum SNR, among the plurality of first to m-th arrangement ranges, may be previously set to the start arrangement range.

The phase control unit may apply all the phase weight vectors within the start arrangement range among the first to m-th arrangement range of the phase weight vector codebook, and decide the maximum SNR among the SNRs of the applied phase weight vectors.

The phase control section may apply two preset phase weight vectors within the start arrangement range among the first to m-th arrangement ranges of the phase weight vector codebook, and decide the maximum SNR among the SNRs of phase weight vectors preceding or succeeding the phase weight vector having the large SNR, according to a comparison result obtained by comparing the magnitudes of the applied two phase weight vectors.

According to another aspect of the present invention, there is provided a beamforming method which is applied to a multi-antenna system including a phase control unit including a plurality of phase shifters which respectively control the phases of signals received from a plurality of antennas according to a preset phase weight vector; a signal combination unit combining the signals outputted from the plurality of phase shifters; a frequency down converter down-converting the combined signal outputted from the signal combination unit into a baseband signal; and an A/D converter converting the baseband signal outputted from the frequency down converter into a digital signal. The beamforming method includes: performing an SNR detection operation of providing a plurality of phase weight vectors contained in a preset phase weight vector codebook to the phase control unit according to a preset application sequence, and detecting a plurality of SNRs corresponding to the applied phase weight vectors by using the digital signal outputted from the A/D converter; performing an SNR comparison operation of comparing the magnitudes of the plurality of SNRs; performing a maximum SNR decision operation of deciding a maximum SNR according to the comparison result among the plurality of SNRs; and performing a beamforming operation of controlling the beamforming of the phase control unit by using the maximum SNR.

The phase weight vector codebook may include the plurality of phase weight vectors which are divided into a plurality of first to m-th arrangement ranges in consideration of phase correlations.

In the performing of the maximum SNR decision operation, the plurality of phase weight vectors of the phase weight vector codebook may be applied according to the preset application sequence, the plurality of SNRs corresponding to the applied phase weight vectors may be compared, and the maximum SNR may be decided by using the comparison result.

The performing of the maximum SNR decision operation may include: performing a first maximum SNR decision operation of deciding a maximum SNR in a preset start arrangement range among the first to m-th arrangement ranges of the phase weight vector codebook; performing a second maximum SNR decision operation of deciding maximum SNRs in the other arrangement ranges by using the periodicity of the SNRs which occurs depending on arrangement ranges having the phase correlations among the plurality of phase weight vectors; and performing a third maximum SNR decision operation of deciding a maximum SNR having the greatest value among the SNRs of the first to m-th arrangement ranges.

An arrangement range in which the maximum SNR is highly likely to be searched for, among the plurality of first to m-th arrangement ranges, may be previously set to the start arrangement range.

An intermediate arrangement range which is expected to be favorable for reducing the search time of the maximum SNR, among the plurality of first to m-th arrangement ranges, may be previously set to the start arrangement range.

In the performing of the first maximum SNR decision operation, a maximum SNR may be decided among the SNRs of all the phase weight vectors within the start arrangement range among the first to m-th arrangement ranges of the phase weight vector codebook.

In the performing of the first maximum SNR decision operation, the magnitudes of two preset phase weight vectors within the start arrangement range among the first to m-th arrangement ranges of the phase weight vector codebook may be compared, and a maximum SNR may be decided among the SNRs of phase weight vectors preceding or succeeding the phase weight vector having the large SNR according to the comparison result.

In the performing of the second maximum SNR decision operation, the maximum SNRs in the other arrangement ranges may be decided by using the periodicity of the SNRs which occurs depending on the arrangement ranges having the phase correlations among the plurality of phase weight vectors.

In the performing of the second maximum SNR decision operation, the magnitude of the maximum SNR of the start arrangement range and the magnitude of a maximum SNR of another arrangement range adjacent to the start arrangement range may be compared, and a maximum SNR having the greatest value may be decided among the SNRs of the arrangement ranges preceding or succeeding the arrangement range having the larger SNR by using the periodicity of the SNRs which occurs depending on the phase correlations among the plurality of phase weight vectors.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
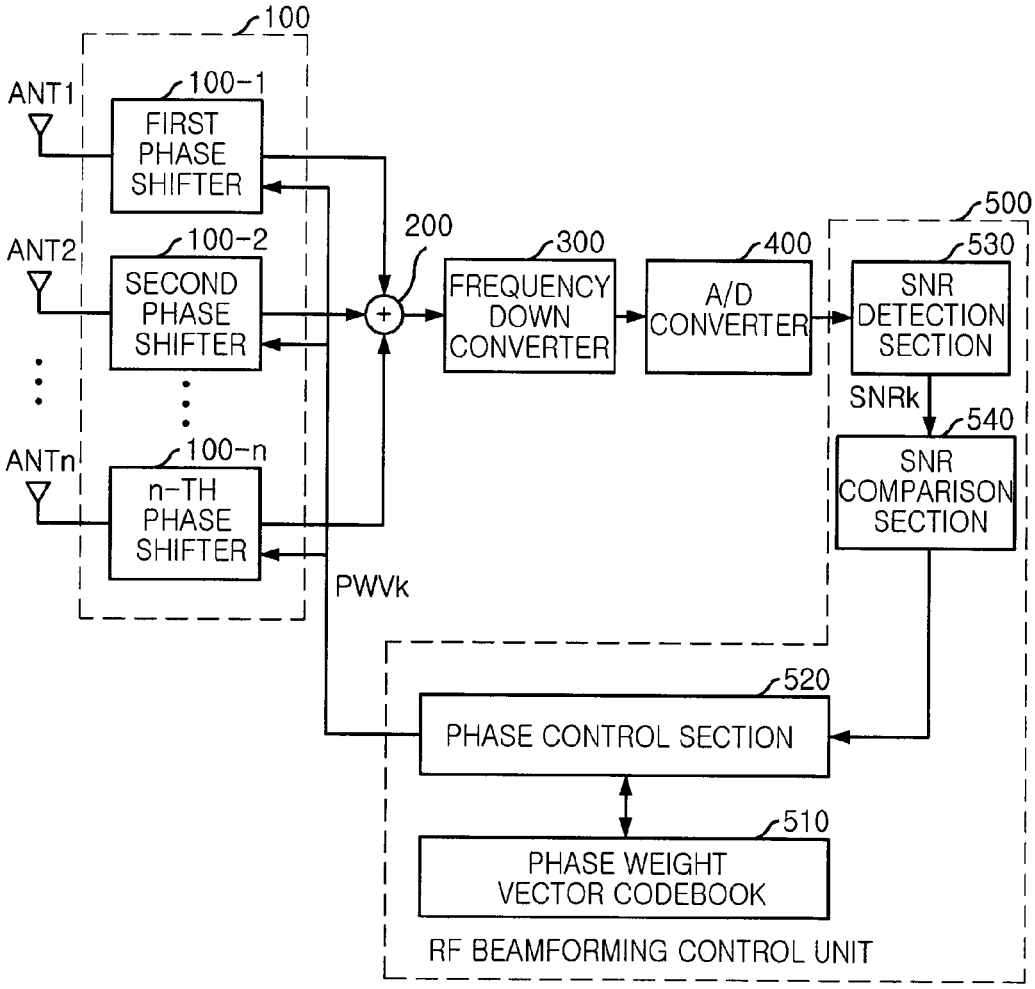
FIG. 1 is a block diagram of a beamforming apparatus for a multi-antenna system according to an embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the thicknesses of layers and regions are exaggerated for clarity. Like reference numerals in the drawings denote like elements, and thus their description will be omitted.

FIG. 1 is a block diagram of a beamforming apparatus for a multi-antenna system according to an embodiment of the present invention.

Referring to FIG. 1, the beamforming apparatus for a multi-antenna system according to the embodiment of the present invention includes a phase control unit 100, a signal combination unit 200, a frequency down converter 300, an analog/digital converter 400, and a radio frequency (RF) beamforming control unit 500. The phase control unit 100 includes a plurality of phase shifters 100-1 to **100-*n* which control the phases of signals received from a plurality of antennas ANT1 to ANTn, respectively, according to a preset phase weight vector. The signal combination unit 200 combines the signals outputted from the plurality of phase shifters 100-1 to 100-*n*. The frequency down converter 300 down-converts the combined signal outputted from the signal combination unit 200 into a baseband signal. The A/D converter 400 converts the baseband signal transferred from the frequency down converter 300 into a digital outputted. The RF beamforming control unit 500 provides a plurality of phase weight vectors included in a preset phase weight vector codebook to the phase control unit 100 according to a preset application sequence, decides a maximum SNR SNRmax among a plurality of SNRs corresponding to the plurality of applied phase weight vectors by using the digital signal transferred from the A/D converter 400, and controls beamforming of the phase control unit 100** by using the maximum SNR SNRmax.

The RF beamforming control unit 500 may include a phase weight vector codebook 510, a phase control section 520, an SNR detection section 530, and an SN comparison section 540. The phase weight vector codebook 510 includes the plurality of phase weight vectors PWV1 to PWVn which are divided into a plurality of first to m-th arrangement ranges AR[1] to AR[m] in consideration of phase correlations. The phase control section 520 applies the plurality of phase weight vectors PWV1 to PWVn of the phase weight vector codebook 510 according to the present application sequence, decides the maximum SNR SNRmax by using comparison results among the plurality of SNRs corresponding to the applied phase weight vectors, and controls the respective phases of the phase shifters 100-1 to **100-*n* by using the maximum SNR SNRmax. The SNR detection section 530 detects SNRs for the applied phase weight vectors, respectively, by using the digital signal transferred from the A/D converter 400. The SNR comparison section 540 compares the SNRs for the applied phase weight vectors, which are transferred from the SNR detection section 530, and provides the comparison result to the phase control section 520**.

The phase control section 520 may decide a maximum SNR SNRmax[k] in a preset start arrangement range AR[k] among the first to m-th arrangement ranges AR[1] to AR[m] of the phase weight vector codebook 510 by using the comparison result from the SNR comparison section 540, decide maximum SNRs SNRmax in the other arrangement ranges by using the periodicity of the SNRs which occurs depending on the arrangement ranges having the phase correlations among the plurality of phase weight vectors PWV1 to PWVn, and decide a maximum SNR SNRmax having the greatest value among the respective maximum SNRs SNRmax[1] to SNRmax[m] in the first to m-th arrangement ranges AR[1] to AR[m].

Figure 2:
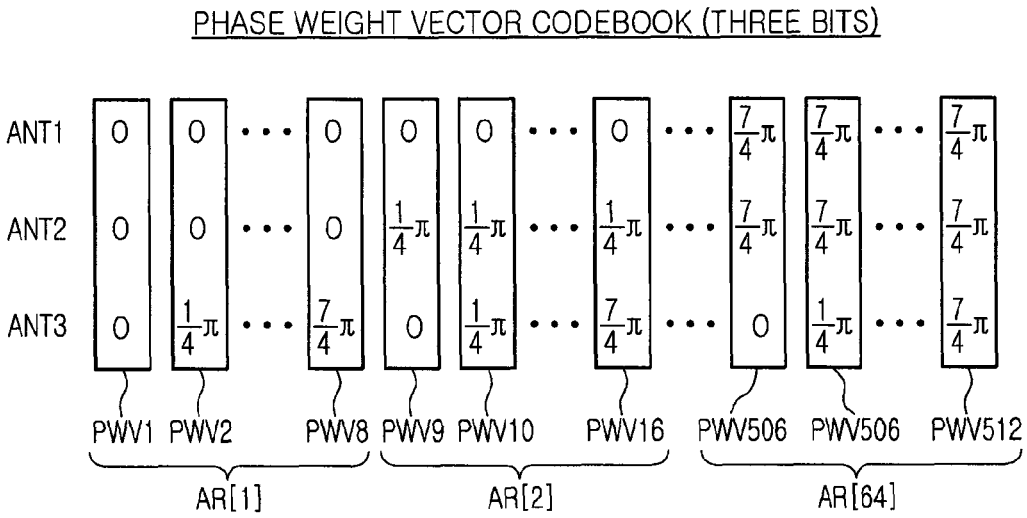
FIG. 2 is a diagram illustrating the arrangement ranges of phase weight vectors of a phase weight vector codebook according to the embodiment of the present invention.

FIG. 2 is a diagram illustrating the arrangement ranges of the phase weight vectors of the phase weight vector codebook according to the embodiment of the present invention. In FIG. 2, the first to m-th arrangement ranges AR[1] to AR[m] of the phase weight vector codebook 510 according to the embodiment of the present invention are divided according to the phase correlations.

An arrangement range in which the maximum SNR is highly likely to be searched for, among the plurality of first to m-th arrangement ranges AR[1] to AR[m], may be previously set to the start arrangement range AR[k].

Alternatively, an intermediate arrangement range which is expected to be favorable for reducing the search time of the maximum SNR, among the first to m-th arrangement ranges AR[1] to AR[m], may be previously set to the start arrangement range AR[k].

The phase control section 520 may apply all the phase weight vectors PWV1 to PWVn within the start arrangement range AR[k] among the first to m-th arrangement ranges AR[1] to AR[m] of the phase weight vector codebook 510, and then decide the maximum SNR SNRmax[k] among the SNRs of the applied phase weight vectors.

Alternatively, the phase control section 520 may apply two preset phase weight vectors within the start arrangement range AR[k] among the first to m-th arrangement ranges AR[1] to AR[m] of the phase weight vector codebook 510, and then decide the maximum SNR SNRmax[k] among the SNRs of the phase weight vectors preceding or succeeding the phase weight vector having the larger SNR, according to a comparison result obtained by comparing the magnitudes of the SNRs of the applied two phase weight vectors.

Figure 3:
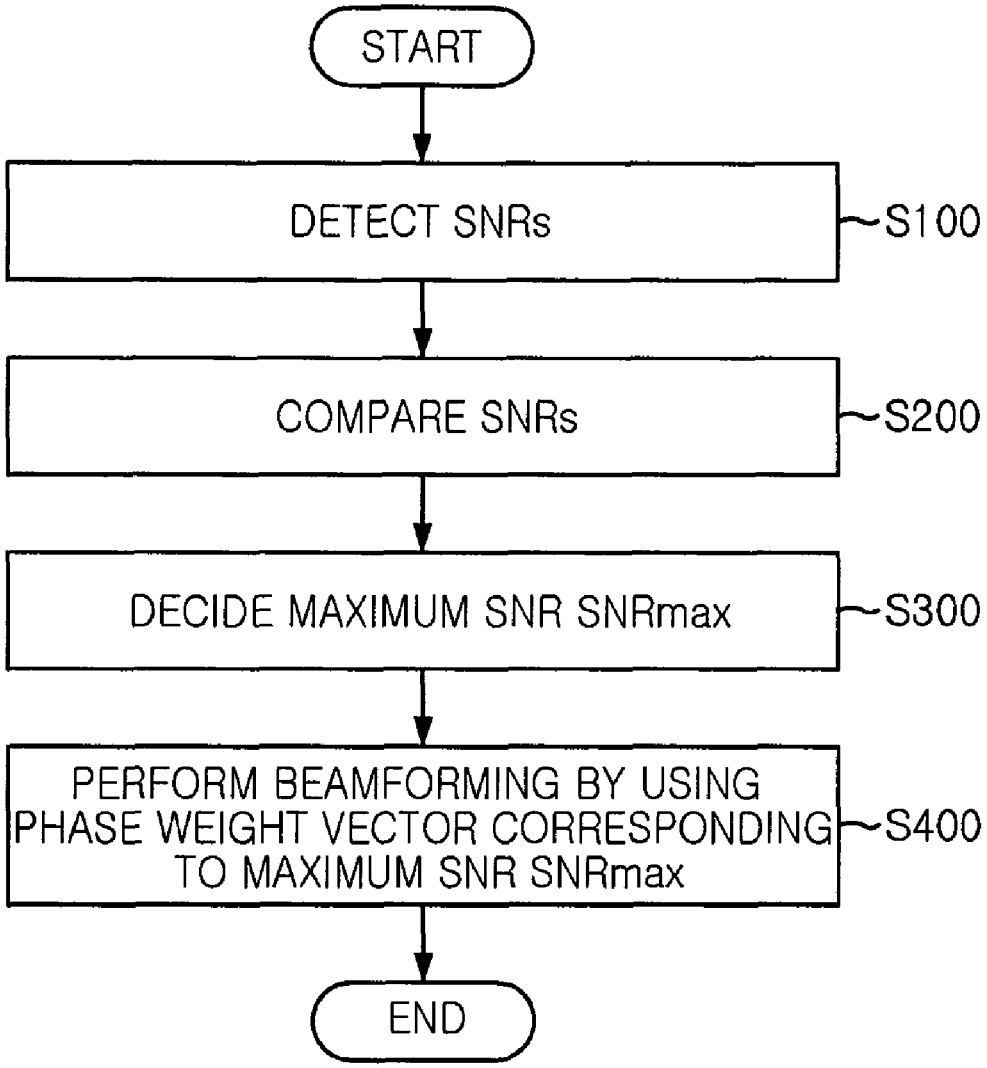
FIG. 3 is a flow chart showing a beamforming method for a multi-antenna system according to another embodiment of the present invention.

FIG. 3 is a flow chart showing a beamforming method for a multi-antenna system according to another embodiment of the present invention.

Referring to FIG. 3, the beamforming method for a multi-antenna system according to the embodiment of the present invention may be applied to a multi-antenna system which includes a phase control unit 100 including a plurality of phase shifters 100-1 to **100-*n* for controlling the phases of signals received from a plurality of antennas ANT1 to ANTn, respectively, according to a preset phase weight vector, a signal combination unit 200 combining the signals outputted from the plurality of phase shifters 100-1 to 100-*n*, a frequency down converter 300 down-converting the combined signal outputted from the signal combination unit 200 into a baseband signal, and an A/D converter 400 converts the baseband signal outputted from the frequency down converter 300** into a digital signal.

The beamforming method for a multi-antenna system according to the embodiment of the present invention may include an SNR detection operation S100, an SNR comparison operation S200, a maximum SNR decision operation S300, and a beamforming operation S400. In the SNR detection operation S100, a plurality of phase weight vectors PWV1 to PWVn included in a preset phase weight vector codebook 510 are provided to the phase control unit 100 according to a preset application sequence, and a plurality of SNRs corresponding to the applied phase weight vectors are detected by using digital signal outputted from the A/D converter 400. In the SNR comparison operation S200, the magnitudes of the plurality of SNRs are compared. In the maximum SNR decision operation S300, a maximum SNR SNRmax is decided according to the comparison result of the SNRs. In the beamforming operation S400, the beamforming of the phase control unit 100 is controlled by using the maximum SNR SNRmax.

The phase weight vector codebook 510 includes the plurality of phase weight vectors PWV1 to PWVn which may be divided into a plurality of first to m-th arrangement ranges AR[1] to AR[m] in consideration of phase correlations.

In the maximum SNR decision operation S300, the plurality of phase weight vector PWV1 to PWVn of the phase weight vector codebook 510 are applied according to the preset application sequence, and the maximum SNR SNRmax is decided by using the comparison result among the plurality of SNRs corresponding to the applied phase weight vectors.

Figure 4:
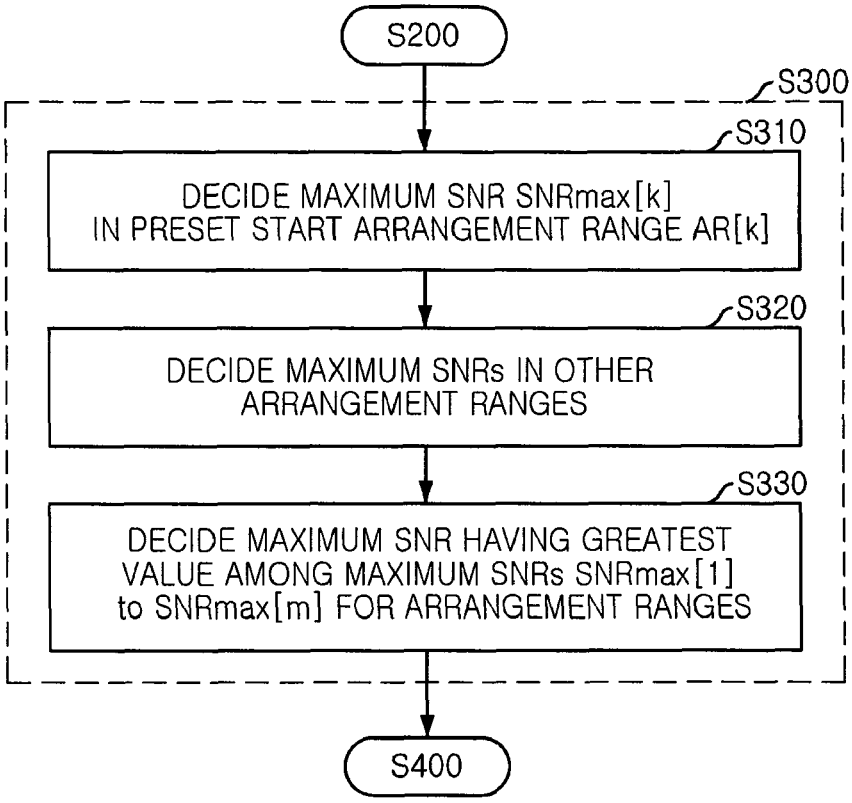
FIG. 4 is a flow chart of a maximum SNR decision operation according to the embodiment of the present invention.

FIG. 4 is a flow chart of the maximum SNR decision operation 300 according to the embodiment of the present invention.

Referring to FIG. 4, the maximum SNR decision operation S300 may include a first maximum SNR decision operation S310 in which a maximum SNR SNRmax[k] is decided in a preset start arrangement range AR[k] among the first to m-th arrangement ranges AR[1] to AR[m] of the phase weight vector codebook 510, a second maximum SNR decision operation S320 in which maximum SNRs are decided in the other arrangement ranges by using the periodicity of the SNRs which occurs depending on the arrangement ranges having the phase correlations among the phase weight vectors PWV1 to PWVn, and a third maximum SNR decision operation S330 in which a maximum SNR having the greatest value is decided among the maximum SNRs of the first to m-th arrangement ranges AR[1] to AR[m].

In this case, an arrangement range in which the maximum SNR is highly likely to be searched for, among the plurality of first to m-th arrangement ranges AR[1] to AR[m], may be previously set to the start arrangement range AR[k].

Alternatively, an intermediate arrangement range which is expected to be favorable for reducing the search time of the maximum SNR, among the first to m-th arrangement ranges AR[1] to AR[m], may be previously set to the start arrangement range AR[k].

Figure 5:
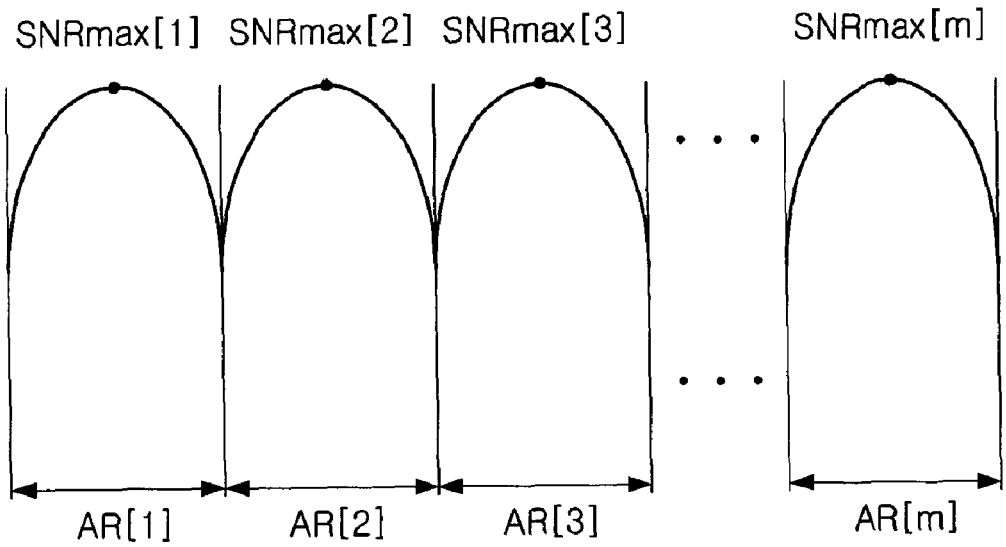
FIG. 5 is a graph showing the maximum SNR for the respective arrangement ranges according to the embodiment.

FIG. 5 is a graph showing the maximum SNRs for the respective arrangement ranges according to the embodiment.

Referring to FIG. 5, it can be seen that, when the phase weight vectors included in the first to m-th arrangement ranges AR[1] to AR[m] of the phase weight vector codebook 510 according to the embodiment of the present invention are applied, the first to m-th arrangement ranges AR[1] to AR[m] include the maximum SNRs SNRmax[1] to SNRmax[m], respectively.

Referring to FIGS. 4 and 5, in the first maximum SNR decision operation S310, the magnitudes of the maximum SNR SNRmax may be decided among the SNRs of the phase weight vectors within the start arrangement range AR[k] among the first to m-th arrangement ranges AR[1] to AR[m] of the phase weight vector codebook 510.

Figure 6:
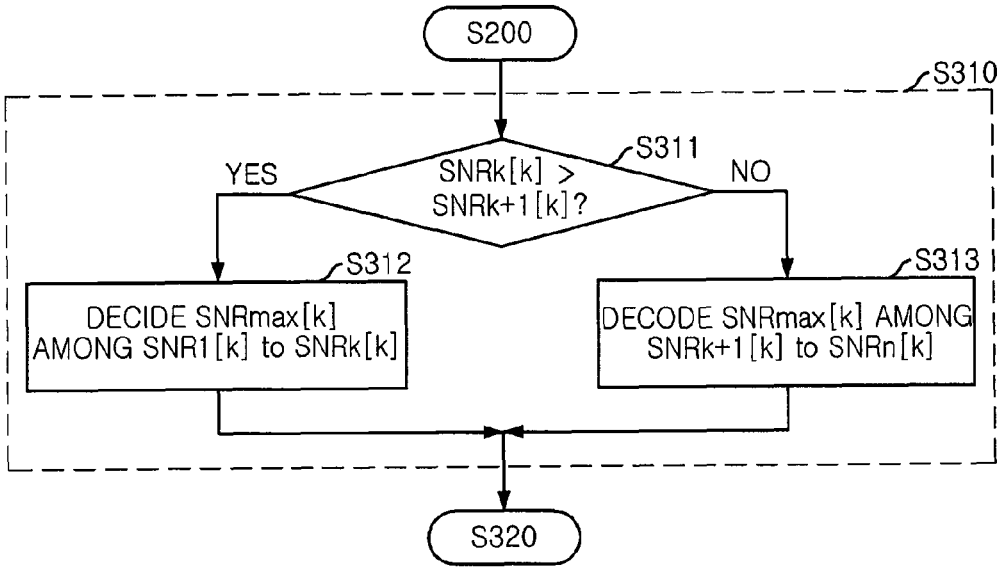
FIG. 6 is a flow chart of a first maximum SNR decision operation according to the embodiment of the present invention.

FIG. 6 is a flow chart of the first maximum SNR decision operation S310 according to the embodiment of the present invention.

Referring to FIG. 6, in the first maximum SNR decision operation S310, the SNRs of two preset phase weight vectors within the start arrangement range AR[k] among the first to m-th arrangement ranges AR[1] to AR[m] of the phase weight vector codebook 510 may be compared, and the maximum SNR SNRmax may be decided among the SNRs of phase weight vectors preceding or succeeding the phase weight vector having the larger SNR according to the comparison result.

Figure 7:
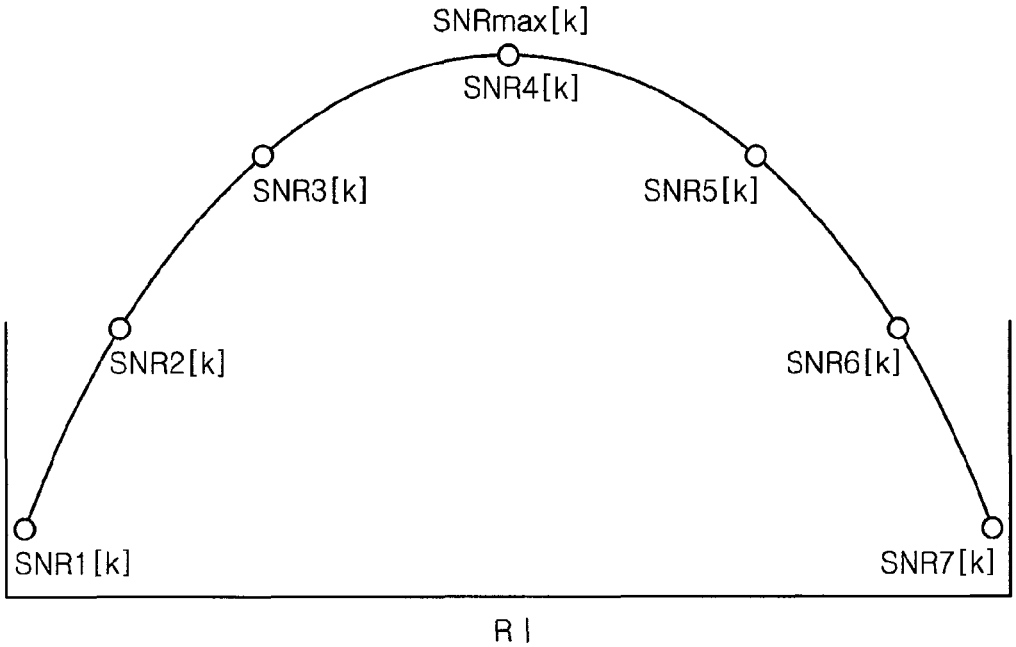
FIG. 7 is a graph showing a maximum SNR in a start arrangement range according to the embodiment of the present invention.

FIG. 7 is a graph showing the maximum SNR in the start arrangement range according to the embodiment of the present invention. FIG. 7 shows an example of the plurality of SNRs SNR1[*k*] to SNR7[*k*] and the maximum SNR SNRmax [k] in the start arrangement range AR[k], when the phase weight vectors included in the start arrangement range AR[k] among the first to m-th arrangement ranges AR[1] to AR[m] of the phase weight vector codebook 510 according to the embodiment of the present invention are applied.

In the second maximum SNR decision operation S320, the maximum SNRs in the other arrangement ranges may be decided by using the periodicity of the SNRs which occurs depending on the arrangement ranges having the phase correlations among the plurality of phase weight vectors PWV1 to PWVn.

Figure 8:
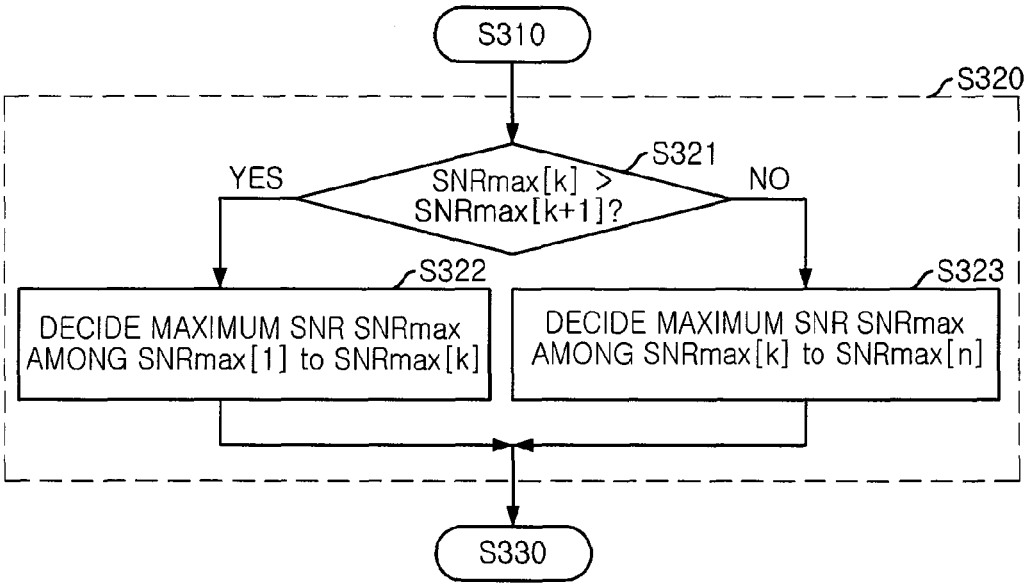
FIG. 8 is a flow chart of a second SNR decision operation according to the embodiment of the present invention.

FIG. 8 is a flow chart of the second SNR decision operation according to the embodiment of the present invention.

Referring to FIG. 8, in the second SNR decision operation S320, the maximum SNR SNRmax[k] of the start arrangement range AR[k] and a maximum SNR SNRmax[k+1] of another arrangement range adjacent to the start arrangement range AR[k] are compared by using the periodicity of the SNRs which occurs depending on the arrangement ranges the phase correlations among the plurality of phase weight vectors PWV1 to PWVn. Then, among the SNRs of the arrangement ranges preceding or succeeding the arrangement range having the larger SNR according to the comparison result, a maximum SNR having the greatest value may be decided.

Figure 9:
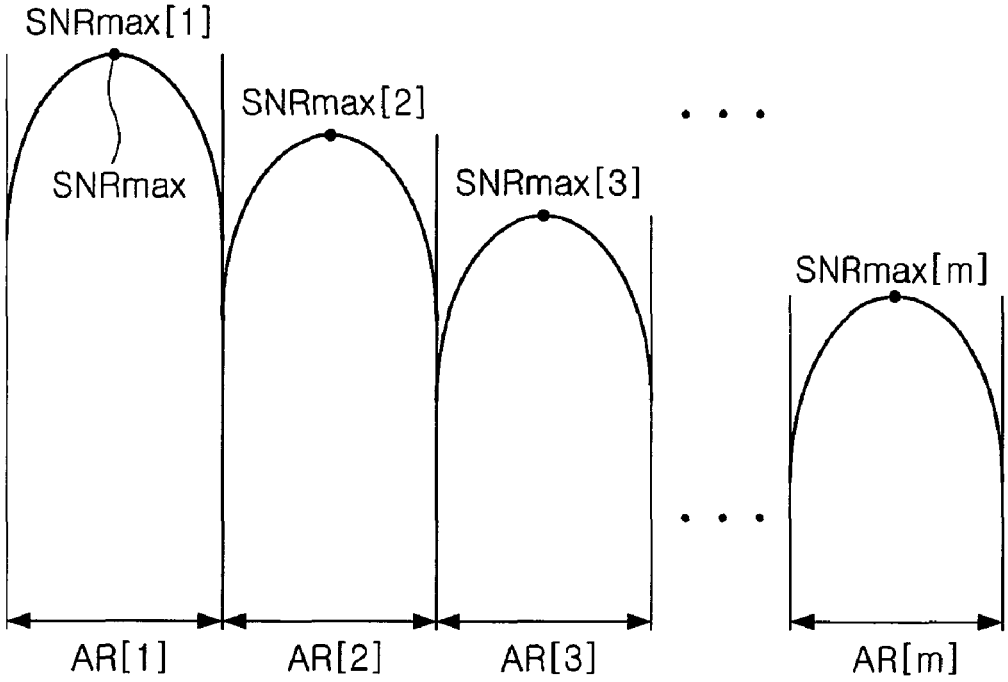
FIG. 9 is a first example graph showing maximum SNRs for the respective arrangement ranges.
Figure 10:
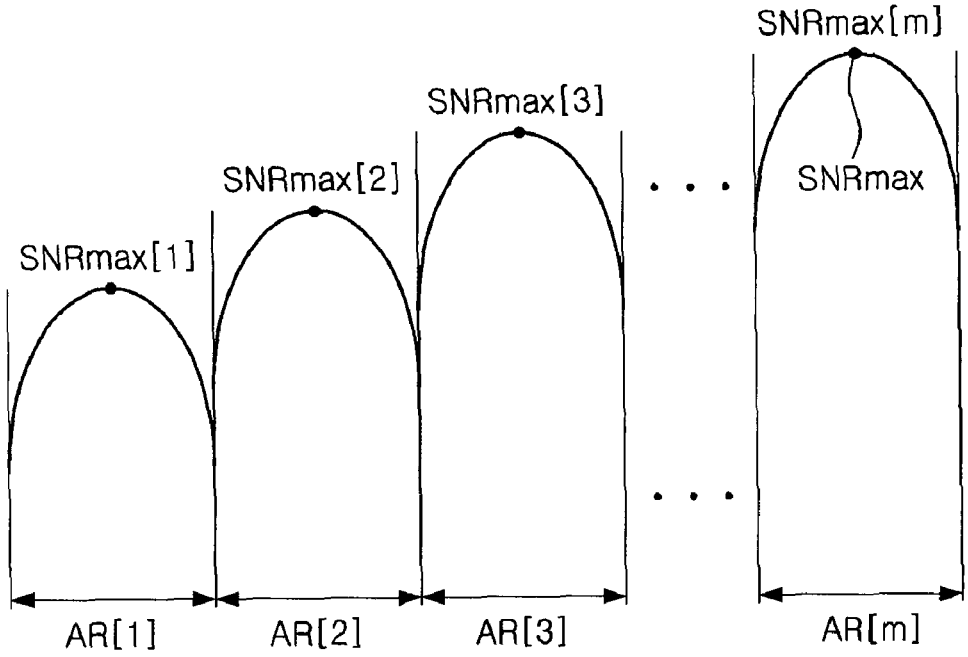
FIG. 10 is a second example graph showing maximum SNRs for the respective arrangement ranges.

FIG. 9 is a first example graph showing the maximum SNRs for the respective arrangement ranges. FIG. 10 is a second example graph showing the maximum SNRs for the respective arrangement ranges.

FIG. 9 shows an example in which the maximum SNRs SNRmax[1] to SNRmax[m] of the first to m-th arrangement ranges ARM to AR[m] of the phase weight vector codebook 510 gradually increase.

FIG. 10 shows an example in which the maximum SNRs SNRmax[1] to SNRmax[m] of the first to m-th arrangement ranges ARM to AR[m] of the phase weight vector codebook 510 gradually decrease.

Hereinafter, the operation and effect of the beamforming apparatus and method for a multi-antenna system according to the embodiments of the present invention will be described.

First, referring to FIGS. 1 and 2, the beamforming apparatus for a multi-antenna system according to the embodiment of the present invention will be described. In FIG. 1, the phase control unit 100 includes the plurality of phase shifters 100-1 to 100-*n* receiving signals from the plurality of antennas ANT1 to ANTn, respectively. The plurality of phase shifters 100-1 to 100-*n* may control the phases of the signals received from the plurality of antennas ANT1 to ANTn according to a preset phase weight vector.

The preset phase weight vector is provided by the RF beamforming control unit 500 which will be described below.

The signal combination unit 200 combines the signals outputted from the plurality of phase shifters 100-1 to **100-*n* and outputs the combined signal to the frequency down converter 300. The frequency down converter 300 down-converts the signal outputted from the signal combination unit 200 into a baseband signal, and outputs the baseband signal to the A/D converter 400. The A/D converter 400 converts the baseband signal outputted from the frequency down converter 300 into a digital signal and outputs the digital signal to the RF beamforming control unit 500**.

The RF beamforming control unit 500 provides a plurality of preset phase weight vectors to the phase control unit 100 according to a preset application sequence. Then, the RF beamforming control unit 500 decides a maximum SNR SNRmax among a plurality of SNRs corresponding to the applied phase weight vectors by using the digital signal outputted from the A/D converter 400, and provides a phase weight vector corresponding to the maximum SNR SNRmax to the phase control unit 100.

Through this process, the RF beamforming control unit 500 according to the embodiment of the present invention may control the RF beamforming.

Referring to FIG. 1, the phase weight vector codebook 510 of the RF beamforming control unit 500 may include the plurality of phase weight vectors PWV1 to PWVn which are divided into the plurality of first to m-th arrangement ranges in consideration of the phase correlations.

At this time, since the plurality of phase weight vectors PWV1 to PWVn are arranged in consideration of the phase correlations, the magnitude variations in the plurality of SNRs corresponding to the respective phase weight vectors PWV1 to PWVn have a constant periodicity.

First, the phase control section 520 of the RF beamforming control unit 500 provides the plurality of phase weight vectors PWV1 to PWVn of the phase weight vector codebook 510 to the phase control unit 100 according to the preset application sequence.

The SNR detection section 530 of the RF beamforming control unit 500 detects the SNRs for the applied phase weight vectors by using the digital signal outputted from the A/D converter 400, and then provides the detected SNRs to the SNR comparison section 540.

The SNR comparison section 540 compares the SNRs for the applied phase weight vectors, which are provided from the SNR detection section 530, and provides the comparison result to the phase control section 520.

The phase control section 520 of the RF beamforming control unit 500 decides the maximum SNR SNRmax among the plurality of SNRs, depending on the comparison result among the plurality of SNRs corresponding to the plurality of phase weight vectors, and provides phase weight vector corresponding to the maximum SNR SNRmax to the phase control unit 100 so as to control the respective phases of the phase shifters 100-1 to **100-*n* of the phase control unit 100**.

The process for acquiring the maximum SNR will be described in more detail as follows. The phase control section 520 decides a maximum SNR SNRmax[k] in a preset start arrangement range AR[k] among the first to m-th arrangement ranges AR[1] to AR[m] of the phase weight vector codebook 510.

Next, the phase control section 520 decides maximum SNRs in the other arrangement ranges by using the periodicity of the SNRs which occurs depending on the arrangement ranges having the phase correlations among the plurality of phase weight vectors.

Then, the phase control section 520 decides a maximum SNR having the greatest value among the maximum SNRs SNRmax[1] to SNRmax[m] of the first to m-th arrangement ranges AR[1] to AR[m].

As the phase weight vector corresponding to the decided maximum SNR is provided to the phase control unit 100, the phase control unit 100 may perform optimal beamforming.

Referring to FIG. 2, the phase weight vectors of the phase weight vector codebook according to the embodiment of the present invention will be described in detail. The first to m-th arrangement ranges AR[1] to AR[m] of the phase weight vector codebook 510 according to the embodiment of the present invention are divided according to the phase correlations.

For example, it may be assumed that each of the phase weight vectors within the phase weight vector codebook 510 is composed of three bits and a multi-antenna system to which the beamforming apparatus according to the embodiment of the present invention is applied includes three antennas ANT1, ANT2, and ANT3. In this case, the size of the phase weight vector codebook 510 may be expressed as Equation 1 below.

$$\text{Size of phase weight vector codebook} = [2^{bit\ number}]^{antenna\ number} = [2^2]^3 = 512. \quad \text{[Equation 1]}$$

Referring to Equation 1, when the phase weight vector is composed of three bits, a total of eight phases, i.e. 0, (¼)π, (2⁄4)π, (3⁄4)π, (4⁄4)π, (5⁄4)(, (6⁄4)(, and (7⁄4)( may be expressed by using the phase weight vector. Therefore, referring to FIG. 2, the plurality of phase weight vectors may be arranged in such a direction that the phases gradually increase from 0 to (7⁄4)(. Then, the phase weight vectors have the phase correlations.

Alternatively, the plurality of phase weight vectors may be arranged in such a direction that the phases gradually decrease.

Meanwhile, an arrangement range in which the maximum SNR is highly likely to be searched for, among the plurality of first to m-th arrangement ranges AR[1] to AR[m], may be previously set to the start arrangement range AR[k]. Alternatively, an intermediate arrangement range which is expected to be favorable for reducing the search time of the maximum SNR, among the first to m-th arrangement ranges AR[1] to AR[m], may be previously set to the start arrangement range AR[k].

For example, an intermediate arrangement range among the entire arrangement ranges may be previously set as the start arrangement range AR[k]. Specifically, when the entire arrangement ranges include first to 64th arrangement ranges AR[1] to AR[64], the 32nd arrangement range AR[32] or 33rd arrangement range AR[33] may be set to the start arrangement range AR[k].

The phase control unit 520 may apply all the phase weight vectors PWV1 to PWVn within the start arrangement range AR[k] among the first to m-th arrangement ranges AR[1] to AR[m] of the phase weight vector codebook 510, and decide the maximum SNR SNRmax[k] among the SNRs of the applied phase weight vectors.

As such, when the detection and comparison processes are performed on the SNRs corresponding to all the phase weight vectors PWV1 to PWVn within the start arrangement range AR[k], it may take some time. The following process may be performed more quickly than the above-described process.

That is, the phase control unit 520 may apply two preset phase weight vectors within the start arrangement range AR[k] among the first to m-th arrangement ranges AR[1] to AR[m] of the phase weight vector codebook 510, and decide a maximum SNR SNRmax[k] among the SNRs of phase weight vectors preceding or succeeding the phase weight vector having the larger SNR, according to a comparison result obtained by comparing the magnitudes of the applied two phase weight vectors.

When the maximum SNR is decided through such a process, the time required for deciding the maximum SNR in the start arrangement range may be reduced.

Hereinafter, referring to FIGS. 1 to 10, the beamforming method for a multi-antenna system according to the embodiment of the present invention will be described.

Referring to FIGS. 1 to 3, the beamforming method for a multi-antenna system according to the embodiment of the present invention may use the beamforming apparatus for a multi-antenna system as illustrated in FIG. 1, and may be performed by the RF beamforming control unit.

Referring to FIGS. 1 to 3, the SNR detection operation S100 in the beamforming method for a multi-antenna system according to the embodiment of the present invention will be described. In the SNR detection operation S100, the plurality of phase weight vectors PWV1 to PWVn included in the phase weight vector codebook 510 are applied to the phase control unit 100 according to the preset application sequence. Then, a plurality of SNRs corresponding to the applied phase weight vectors are detected by using the digital signal outputted from the A/D converter 400.

In the SNR comparison operation S200, the magnitudes of the plurality of SNRs provided from the SNR detection operation S100 are compared, and the comparison result is provided to the maximum SNR decision operation S300.

In the maximum SNR decision operation S300, a maximum SNR SNRmax is decided according to the comparison result among the plurality of SNRs, and the maximum SNR SNRmax and a phase weight vector corresponding to the maximum SNR SNRmax are provided to the beamforming operation S400.

In the beamforming operation S400, the phase weight vector corresponding to the maximum SNR SNRmax is provided to the phase control unit 100 so as to control the beamforming of the phase control unit 100.

As described with reference to FIG. 2, the phase weight vector codebook 510 includes the plurality of phase weight vectors PWV1 to PWVn which are divided into the plurality of first to m-th arrangement ranges in consideration of the phase correlations.

In the maximum SNR decision operation S300, the plurality of phase weight vectors PWV1 to PWVn of the phase weight vector codebook 510 are applied according to the preset application sequence, the magnitudes of the plurality of SNRs corresponding to the applied phase weight vectors are compared, and the maximum SNR SNRmax is decided according to the comparison result.

Referring to FIG. 4, the maximum SNR decision operation 300 according to the embodiment of the present invention will be described.

In the first maximum SNR decision operation S310 of the maximum SNR decision operation S300, a maximum SNR SNR[k] is decided in a preset start arrangement range AR[k] among the first to m-th arrangement ranges of the phase weight vector codebook 510, and then provided to the second maximum SNR decision operation S320.

In the second maximum SNR decision operation S320, maximum SNRs in the other arrangement ranges are decided by using the periodicity of the SNRs which occurs depending on the arrangement ranges having the phase correlations among the plurality of phase weight vectors PWV1 to PWVn, and then provided to the third SNR decision operation S330.

In FIG. 5, it can be seen that, when the phase weight vectors included in the first to m-th arrangement ranges AR[1] to AR[m] of the phase weight vector codebook 510 are applied, the first to m-th arrangement ranges AR[1] to AR[m] have the maximum SNRs SNRmax[1] to SNRmax[m], respectively.

In the third maximum SNR decision operation S330, a maximum SNR SNRmax having the greatest value is decided among the maximum SNRs SNRmax[1] to SNRmax[m] of the first to m-th arrangement ranges AR[1] to AR[m].

In this case, an arrangement range in which the maximum SNR is highly likely to be searched for, among the plurality of first to m-th arrangement ranges AR[1] to AR[m], may be previously set to the start arrangement range AR[k]. Alternatively, an intermediate arrangement range which is expected to be favorable for reducing the search time of the maximum SNR, among the first to m-th arrangement ranges AR[1] to AR[m], may be previously set to the start arrangement range AR[k].

For example, an intermediate arrangement range among the entire arrangement ranges may be previously set to the start arrangement range AR[k]. Specifically, when the entire arrangement ranges include first to 64th arrangement ranges AR[1] to AR[64], the 32nd arrangement range AR[32] or 33rd arrangement range AR[33] may be set to the start arrangement range AR[k].

In the first maximum SNR decision step S310 as described above, the maximum SNR SNRmax is decided among the SNRs of the entire phase weight vectors within the start arrangement range AR[k] among the first to m-th arrangement ranges AR[1] to AR[m] of the phase weight vector codebook 510. On the other hand, as shown in FIG. 6, the maximum SNR may be decided more quickly on the basis of the magnitude direction of the SNRs.

Referring to FIG. 6, in the first maximum SNR decision operation S310, the magnitudes of the SNRs of two preset phase weight vectors within the start arrangement range AR[k] among the first to m-th arrangement ranges AR[1] to AR[m] of the phase weight vector codebook 510 may be compared, and the maximum SNR SNRmax may be decided among the phase weight vectors preceding or succeeding the phase weight vector having the larger SNR according to the comparison result.

FIG. 7 shows an example of the plurality of SNRs SNR1[*k*] to SNR7[*k*] and the maximum SNR SNRmax[k] in the start arrangement range AR[k], when the phase weight vectors included in the start arrangement range AR[k] among the first to m-th arrangement ranges AR[1] to AR[m] of the phase weight vector codebook 510 according to the embodiment of the present invention are applied.

In the second SNR decision operation 320, the maximum SNRs in the other arrangement ranges may be decided by using the periodicity of the SNRs which occurs depending on the arrangement ranges having the phase correlations among the plurality of phase weight vectors PWV1 to PWVn. On the other hand, referring to FIG. 8, the maximum SNR may be decided more quickly on the basis of the magnitude direction of the maximum SNRs.

Referring to FIG. 8, in the second SNR decision operation S320, the maximum SNR SNRmax[k] of the start arrangement range AR[k] and a maximum SNR SNRmax[k+1] of another arrangement range adjacent to the start arrangement range AR[k] are compared by using the periodicity of the SNRs which occurs depending on the arrangement ranges having the phase correlations among the plurality of phase weight vectors PWV1 to PWVn. Then, among the SNRs of the arrangement ranges preceding or succeeding the arrangement range having the larger SNR according to the comparison result, a maximum SNR having the greatest value may be decided.

FIGS. 9 and 10 are graphs showing the magnitude direction of the maximum SNRs SNRmax[1] to SNRmax[m] for the first to m-th arrangement ranges of the phase weight vector codebook 510 according to the embodiment of the present invention. FIG. 9 shows an example in which the maximum SNRs SNRmax[1] to SNRmax[m] gradually increase. FIG. 10 shows an example in which the maximum SNRs SNRmax [1] to SNRmax[m] gradually decrease.

Figure 11:
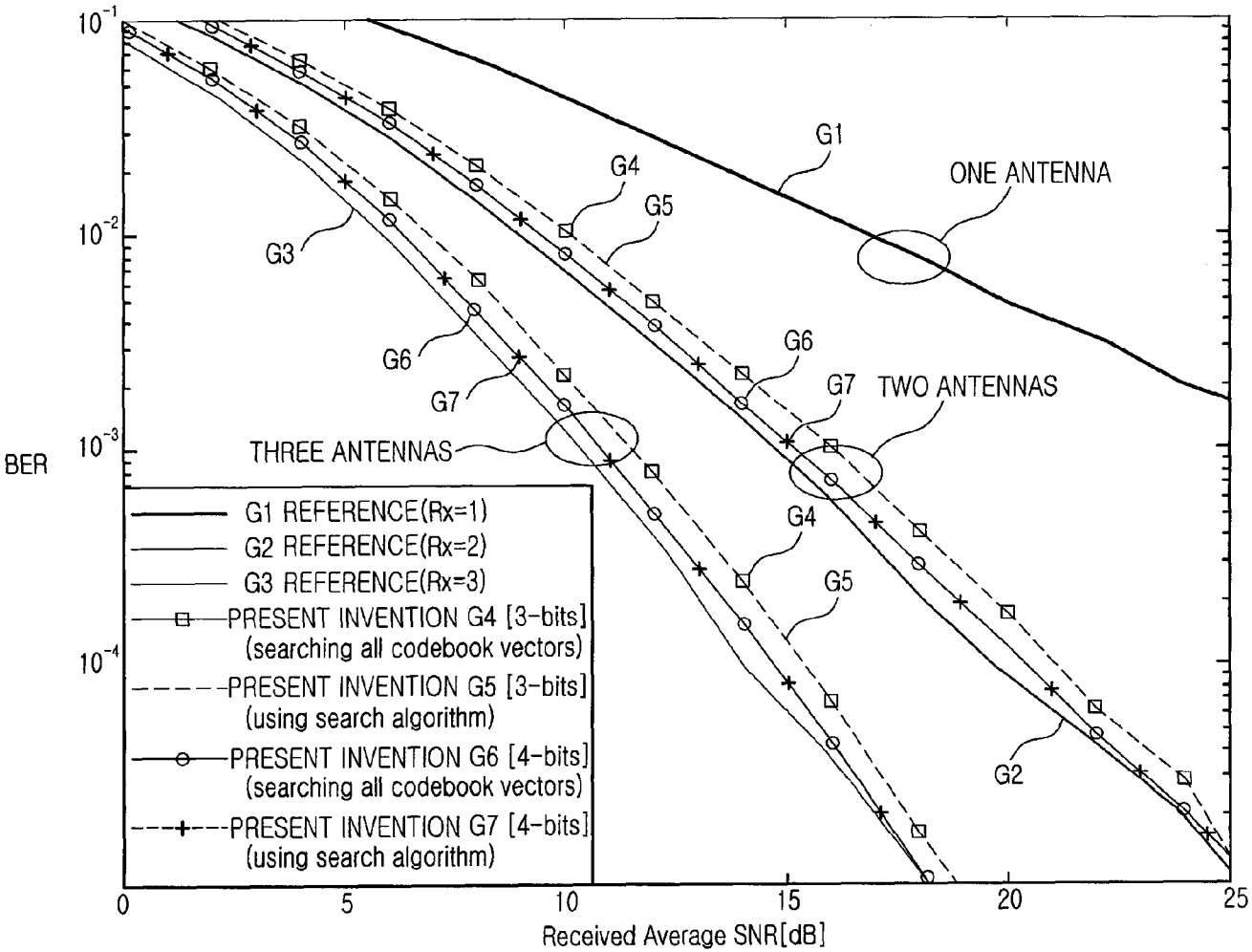
FIG. 11 is a graph showing the relation between bit error rate (BER) and average SNR.

FIG. 11 is a graph showing the relation between bit error rate (BER) and average SNR. Referring to FIG. 11, it can be seen that as the number of antennas (Rx=1, 2, 3) increases, the BER decreases. In FIG. 11, G1, G2, and G3 represent reference graphs according to the baseband beamforming technology. Referring to FIG. 11, it can be seen the RF beamforming technology exhibits similar performance to the baseband beamforming technology in terms of the BER.

The beamforming apparatus and method according to the embodiments of the present invention may use only one A/D converter, while exhibiting similar performance in comparison with the baseband beamforming technology according to the related art. Therefore, it is possible to reduce the power consumption thereof. Furthermore, the time required for deciding the maximum SNR may be reduced to perform the beamforming more quickly.

While the present invention has been shown and described in connection with the exemplary embodiments, it will be apparent to those skilled in the art that modifications and variations can be made without departing from the spirit and scope of the invention as defined by the appended claims.

What is claimed is:

1. A beamforming apparatus for a multi-antenna system, comprising:

a phase control unit comprising a plurality of phase shifters configured to control, according to a preset phase weight vector, the phases of signals from a plurality of antennas, respectively;

a signal combination unit configured to combine signals outputted from the plurality of phase shifters into a combined signal;

a frequency down converter configured to down-convert the combined signal outputted from the signal combination unit into a baseband signal;

an analog/digital (A/D) converter configured to convert the baseband signal outputted from the frequency down converter into a digital signal; and a radio frequency (RF) beamforming control unit configured to provide a plurality of preset phase weight vectors to the phase control unit according to a preset application sequence, configured to decide a maximum signal-to-noise ratio (SNR) among a plurality of SNRs corresponding to the phase weight vectors applied to the phase control unit, by using digital signals outputted from the A/D converter, and configured to control the beamforming of the phase control unit by using the maximum SNR, wherein the RF beamforming control unit comprises:

a phase weight vector codebook comprising the plurality of phase weight vectors, which are divided into a plurality of first to m-th arrangement ranges in consideration of phase correlations;

a phase control section configured to apply the plurality of phase weight vectors of the phase weight vector codebook according to the preset application sequence, configured to decide the maximum SNR by using a comparison result of the plurality of SNRs corresponding to the applied phase weight vectors, and configured to control the respective phases of the plurality of phase shifters by using the maximum SNR;

an SNR detection unit configured to detect the plurality of SNRs for the applied phase weight vector, by using the digital signal outputted from the A/D converter; and an SNR comparison unit configured to compare the detected SNRs for the applied phase weight vectors, which are outputted from the SNR detection unit, and configured to provide the comparison result to the phase control section.

2. The beamforming apparatus of claim 1, wherein the phase control section decides a maximum SNR in a preset start arrangement range among the first to m-th arrangement range of the phase weight vector codebook, decides maximum SNRs in the other arrangement ranges by using periodicity of the SNRs which occurs depending on the arrangement ranges having the phase correlations among the plurality of phase weight vectors, and decides a maximum SNR having the greatest value among the maximum SNRs of the first to m-th arrangement ranges.

3. The beamforming apparatus of claim 2, wherein an arrangement range in which the maximum SNR is to be searched for, among the plurality of first to m-th arrangement ranges, is previously set to the start arrangement range.

4. The beamforming apparatus of claim 2, wherein an intermediate arrangement range which is expected to be favorable for reducing the search time of the maximum SNR, among the plurality of first to m-th arrangement ranges, is previously set to the start arrangement range.

5. The beamforming apparatus of claim 2, wherein the phase control unit applies all the phase weight vectors within the start arrangement range among the first to m-th arrangement range of the phase weight vector codebook, and decides the maximum SNR among the SNRs of the applied phase weight vectors.

6. The beamforming apparatus of claim 2, wherein the phase control section applies two preset phase weight vectors within the start arrangement range, and decides the maximum SNR among the SNRs of phase weight vectors preceding or succeeding the phase weight vector, applied to the phase control unit, having the larger of two SNRs of the applied two preset phase weight vectors.

7. A beamforming method which is applied to a multi-antenna system comprising a phase control unit comprising a plurality of phase shifters configured to control, according to a preset phase weight vector, the phases of signals from a plurality of antennas, respectively; a signal combination unit configured to combine signals outputted from the plurality of phase shifters into a combine signal; a frequency down converter configured to down-convert the combined signal outputted from the signal combination unit into a baseband signal; and an A/D converter configured to convert the baseband signal outputted from the frequency down converter into a digital signal, the beamforming method comprising:

performing an SNR detection operation of providing a plurality of phase weight vectors contained in a preset phase weight vector codebook to the phase control unit according to a preset application sequence, and detecting a plurality of SNRs corresponding to the phase weight vectors, applied to the phase control unit, by using the digital signals outputted from the A/D converter;

performing an SNR comparison operation of comparing the magnitudes of the plurality of SNRs;

performing a maximum SNR decision operation of deciding a maximum SNR according to the comparison result of the SNRs; and performing a beamforming operation of controlling beamforming of the phase control unit by using the maximum SNR, wherein the phase weight vector codebook comprises the plurality of phase weight vectors, which are divided into a plurality of first to m-th arrangement ranges in consideration of phase correlations.

8. The beamforming method of claim 7, wherein, in the performing of the maximum SNR decision operation, the plurality of phase weight vectors of the phase weight vector codebook are applied according to the preset application sequence, the plurality of SNRs corresponding to the phase weight vectors applied to the phase control unit are compared, and the maximum SNR is decided by using the comparison result.

9. A beamforming method which is applied to a multi-antenna system comprising a phase control unit comprising a plurality of phase shifters configured to control, according to a preset phase weight vector, the phases of signals from a plurality of antennas, respectively; a signal combination unit configured to combine signals outputted from the plurality of phase shifters into a combined signal; a frequency down converter configured to down-convert the combined signal outputted from the signal combination unit into a baseband signal; and an A/D converter configured to convert the baseband signal outputted from the frequency down converter into a digital signal, the beamforming method comprising:

performing an SNR detection operation of providing a plurality of phase weight vectors contained in a preset phase weight vector codebook to the phase control unit according to a preset application sequence, and detecting a plurality of SNRs corresponding to the plurality of phase weight vectors, applied to the phase control unit, by using the digital signals outputted from the A/D converter;

performing an SNR comparison operation of comparing the magnitudes of the plurality of SNRs;

performing a maximum SNR decision operation of deciding a maximum SNR according to the comparison result of the plurality of SNRs; and performing a beamforming operation of controlling beamforming of the phase control unit by using the maximum SNR, wherein the phase weight vector codebook comprises the plurality of phase weight vectors, which are divided into a plurality of first to m-th arrangement ranges in consideration of phase correlations wherein, in the performing of the maximum SNR decision operation, the plurality of phase weight vectors of the phase weight vector codebook are applied according to the preset application sequence, the plurality of SNRs corresponding to the phase weight vectors applied to the phase control unit are compared, and the maximum SNR is decided by using the comparison result, wherein the performing of the maximum SNR decision operation comprises:

performing a first maximum SNR decision operation of deciding a maximum SNR in a preset start arrangement range among the first to m-th arrangement ranges of the phase weight vector codebook;

performing a second maximum SNR decision operation of deciding maximum SNRs in the other arrangement ranges by using the periodicity of the SNRs which occurs depending on arrangement ranges having the phase correlations among the plurality of phase weight vectors; and performing a third maximum SNR decision operation of deciding a maximum SNR having the greatest value among the SNRs of the first to m-th arrangement ranges.

10. The beamforming method of claim 9, wherein an arrangement range in which the maximum SNR to be searched for, among the plurality of first to m-th arrangement ranges, is previously set to the start arrangement range.

11. The beamforming method of claim 9, wherein an intermediate arrangement range which is expected to be favorable for reducing the search time of the maximum SNR, among the plurality of first to m-th arrangement ranges, is previously set to the start arrangement range.

12. The beamforming method of claim 9, wherein, in the performing of the first maximum SNR decision operation, a maximum SNR is decided among the SNRs of all the phase weight vectors within the start arrangement range.

13. The beamforming method of claim 9, wherein, in the performing of the first maximum SNR decision operation, the magnitudes of two SNRs of two preset phase weight vectors within the start arrangement range are compared, and the maximum SNR is decided among the SNRs of phase weight vectors preceding or succeeding the phase weight vector having the larger of the two SNRs, according to the comparison result.

14. The beamforming method of claim 10, wherein, in the performing of the second maximum SNR decision operation, the maximum SNRs in the other arrangement ranges are decided by using the periodicity of the SNRs which occurs depending on the arrangement ranges having the phase correlations among the plurality of phase weight vectors.

15. The beamforming method of claim 9, wherein, in the performing of the second maximum SNR decision operation, the magnitude of the maximum SNR of the start arrangement range and the magnitude of a maximum SNR of another arrangement range adjacent to the start arrangement range are compared, and a maximum SNR having the greatest value is decided among the SNRs of the arrangement ranges preceding or succeeding the arrangement range having the larger of the SNRs of the compared start and another arrangement ranges, by using the periodicity of the SNRs which occurs depending on the phase correlations among the plurality of phase weight vectors.

* * * * *